United States Patent [19]

Nilssen

[11] Patent Number: 4,667,133

[45] Date of Patent: May 19, 1987

[54] POWER-LIMITED LIGHTING SYSTEM

[76] Inventor: Ole K. Nilssen, Caesar Dr., Barrington Hills, Ill. 60010

[21] Appl. No.: 573,423

[22] Filed: Jan. 24, 1984

Related U.S. Application Data

[63] Continuation-in-part of Ser. No. 450,187, Dec. 12, 1983.

[51] Int. Cl.[4] ..... H05B 37/00; H05B 39/00; H05B 41/00

[52] U.S. Cl. ..... 315/312; 315/210; 315/324; 315/256; 361/377; 362/148

[58] Field of Search ..... 315/209 R, 210, 161, 315/312, 324, 231, 256; 362/148; 363/146; 361/377, 90; 307/82

[56] References Cited

U.S. PATENT DOCUMENTS

| | | | |
|---|---|---|---|
| 2,965,804 | 12/1960 | Roesel, Jr. et al. | 315/324 X |
| 3,405,315 | 10/1968 | Moreland II | 315/324 X |
| 3,727,104 | 4/1973 | Neal et al. | 315/256 |
| 3,801,865 | 4/1974 | Roberts | 315/209 R X |
| 4,293,799 | 10/1981 | Roberts | 315/324 X |
| 4,363,082 | 12/1982 | Roland | 362/148 |
| 4,398,126 | 8/1983 | Zuchtriegel | 315/209 R X |

FOREIGN PATENT DOCUMENTS

| | | | |
|---|---|---|---|
| 633937 | 1/1962 | Canada | 362/148 |
| 2089016A | 6/1982 | United Kingdom | 362/148 |

*Primary Examiner*—Saxfield Chatmon

[57] ABSTRACT

Subject power-limited lighting system consists of the following principal component parts: (a) a number of power-line-operated power supplies, each such power supply having a plurality of individual output receptacles, with each output receptacle being limited in terms of maximum voltage, current and power in such a way as to be classified as a Class-3 circuit according to the National Electrical Code; (b) for each power supply, a plurality of lighting units, each such lighting unit comprising one or more lamps (H.I.D., fluorescent and/or incandescent) and corresponding matching networks operative to derive the requisite lamp operating voltages and currents from one of the power supply's voltage/current/power-limited output receptacles; (c) a plurality of pairs of conductor wires adapted to provide for easy plug-in connection between each of the individual power-limited output receptacles of said power supplies and each individual lighting unit--generally with one such lighting unit being connected with each of said output receptacles. With the disclosed lighting system, the individual lighting units and the corresponding wiring means can safely and easily be installed and/or removed by persons of but ordinary skills.

21 Claims, 4 Drawing Figures

POWER-LIMITED LIGHTING SYSTEM

RELATED PATENT APPLICATION

The Applicant of the instant patent application filed a related parent patent application entitled "Limited-Power Fluorescent Ceiling Lighting System" on 12-12-83 (Serial No. 06/450,187) of which this is a continuation-in-part thereof.

BACKGROUND OF THE INVENTION

1. Field of Invention

The present invention relates to power-line-operated Class-2 and Class-3 power-limited lighting systems.

2. Description of Prior Art

Power-line-operated Class-2 or Class-3 power-limited lighting systems have not previously been described in published literature.

GENERAL CONSIDERATIONS

Due to their non-power-limited nature, presently available power-line-operated electric lighting fixtures can not safely and conveniently be installed by persons of but ordinary skills. Moreover, the wiring means required for safe installation is costly to buy and cumbersome even for electricians to install.

On the other hand, if the lighting fixtures could be powered by way of power-limited circuits of Class-3 rating according to the National Electrical Code, they could indeed conveniently and safely be installed by persons of but ordinary skills.

However, the power output available from a Class-3 circuit is normally limited to 100 Volt-Amp; and would not appear to yield enough power to provide an amount of illumination that would be considered adequate in a substantial number of ordinary lighting system installations.

Yet, within its 100 Volt-Amp rating, a Class-3 circuit can deliver enough power to provide for an amount of illumination that is nearly equal to that normally obtained from one of the very commonly used four-lamp flourescent ceiling fixtures—especially if the fluorescent lamps therein were to be of the high efficiency type and provided with high frequency current.

Hence, if means were provided by which such ceiling fixtures could each be powered by way of a Class-3 power source, a very safe and easy-to-install and simple-to-modify power-line-operated ceiling lighting system might be had.

Against this background, it appears useful to provide for such a Power-Limited Lighting System; which is indeed the overall object of the instant invention.

SUMMARY OF THE INVENTION

Objects of the Invention

A first object of the present invention is that of providing an easy-to-install power-line-operated lighting system.

A second object is that of providing a power-line operated lighting system that is adapted to be installed readily and safely by persons of but ordinary skills.

A third object is that of providing means by which power-line-operated lighting fixtures can safely and easily be installed and/or removed by the do-it-yourself'er without requiring the assistance of an electrician.

These as well as other objects, features and advantages of the present invention will become apparent from the following description and claims.

Brief Description

Subject invention constitutes a power-limited lighting system; which, in its preferred embodiment, consists of the following principal component parts:

(a) a number of power-line-operated power supplies, each such power supply having a plurality of individual output receptacles, with each output receptacle being limited in terms of maximum voltage, current and power in such a way as to be classified as a Class-3 circuit according to the National Electrical Code;

(b) for each power supply, a plurality of lighting units, each such lighting unit comprising one or more lamps (H.I.D., fluorescent and/or incandescent) and corresponding matching networks operative to derive the requisite lamp operating voltages and currents from one of the power supply's voltage/current/power-limited output receptacles; and (c) a plurality of pairs of conductor wires adapted to provide for easy plug-in connection between each of the individual output receptacles of said power supplies and each individual lighting unit -- generally with one such lighting unit being connected with each of said output receptacles.

With the disclosed lighting system, the individual lighting units (which may be of fixtured and/or non-fixtured types) and the corresponding wiring means can safely and easily be installed and/or removed by persons of but ordinary skills.

The power provided to each lighting unit is provided at a high power factor; thereby, under the Class-3 provisions of the National Electrical Code, permitting a power level of nearly 100 Watt to be provided to each lighting unit.

DESCRIPTION OF THE PREFERRED EMBODIMENT

Details of System and Circuits

Figure 1:
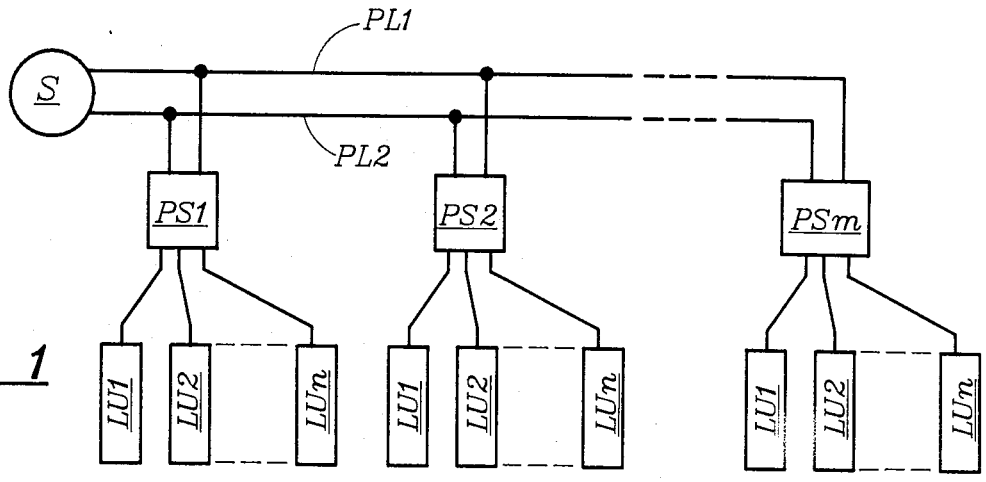
FIG. 1 schematically illustrates the preferred embodiment of the invention and shows a number of power-line-operated inverter power supplies, each providing a plurality of power-limited high-frequency AC voltage outputs for operation of a corresponding plurality of individual lighting units.

In FIG. 1, a source S of 120 Volt/60 Hz voltage is applied to a pair of power line conductors PL1 and PL2. Connected at various points along this pair of power line conductors are a number m of power-line-operated inverter power supplies PS1, PS2–PSm.

To each such power-line-operated power supply are connected a variable number n of lighting units LU1, LU2–LUn. (The number n may be different for different power supplies and/or at different times.)

Figure 2:
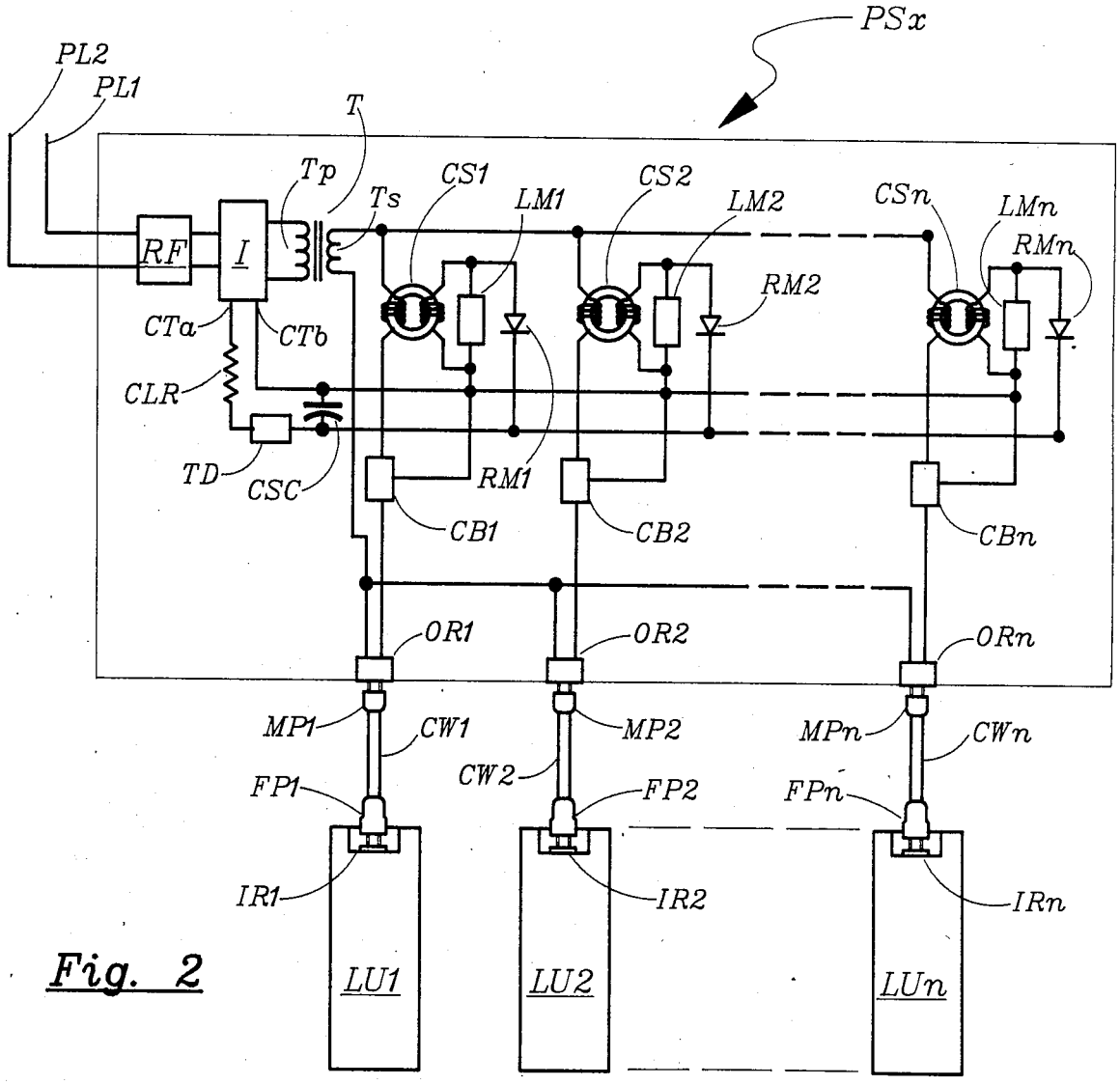
FIG. 2 schematically illustrates the preferred embodiment of one of said power-line-operated power supplies and its plurality of power-limited outputs and individual connections with a corresponding plurality of lighting units.

FIG. 2 illustrates in further detail one of the power supplies of FIG. 1 and its associated n lighting units. This one power supply is referred to as PSx, and is powered from power line cnductors PL1 and PL2.

Inside PSx, power line conductors PL1 and PL2 are directly connected with a rectifier-filter combination RF, the substantially constant DC output voltage of which is applied to an inverter I; which inverter has a pair of control terminals CTa and CTb operative to disable the inverter by application thereto of a disable current.

The output from inverter I is a 30 kHz AC voltage, which AC voltage is applied to the primary winding Tp of an isolating transformer T.

The output of transformer T is provided from its secondary winding Ts and is a 30 kHz AC voltage of approximately 100–150 Volt RMS magnitude.

By way of a number n of current sensors CS1, CS2–CSn and circuit breakers CB1, CB2–CBn, the transformer output voltage is supplied to a number n of power output receptacles OR1, OR2–ORn, all respectively.

Each current sensor is connected with a load means LM1, LM2–LMn; and the outputs from the loaded current sensors are applied by way of rectifier means RM1, RM2–RMn to a common charge-storing capacitor CSC. The output from CSC is applied by way of a threshold device TD, which is connected in series with a current-limiting resistor CLR, to control terminal CTa on inverter I.

By way of male plugs MP1, MP2–MPn, conduction wire-pairs CW1, CW2–CWn, and female plugs FP1, FP2–FPn, the female output receptacles OR1, OR-2–ORn are connected with male input receptacles IR1, IR2–IRn on lighting units LU1, LU2–LUn, all respectively.

The assembly consisting of rectifier and filter means RF, inverter I, transformer T, current sensors CS1, CS2–CSn, load means LM1, LM2–LMn, rectifier means RM1, RM2–RMn, capacitor CSC, threshold device TD, resistor CLR, circuit breakers CB1, CB2–CBn, and the n output receptacles OR1, OR-2–ORn, is referred to as power supply PSx.

Figure 3:
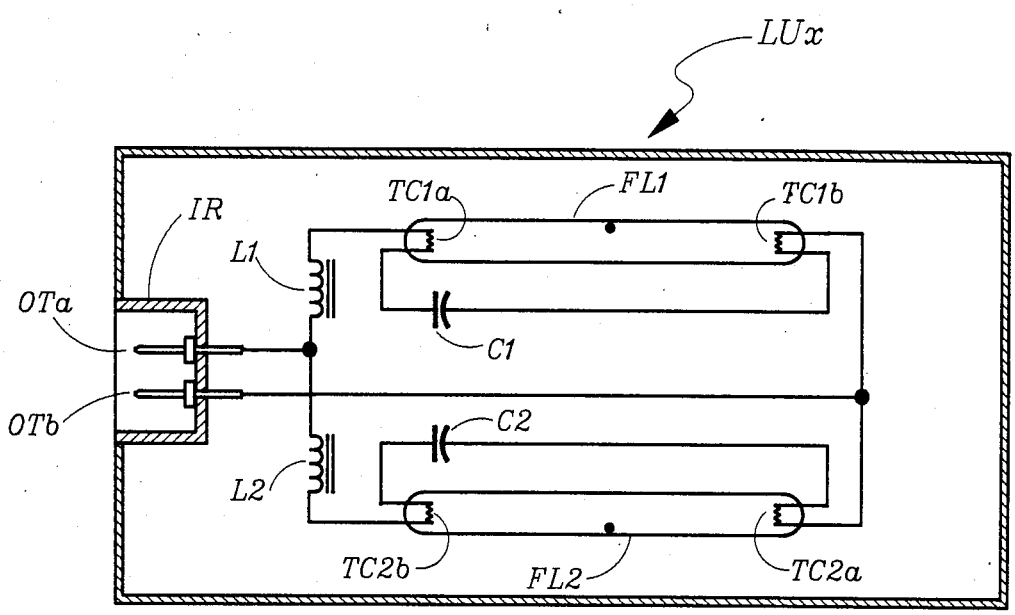
FIG. 3 schematically illustrates electrical circuit details of an individual fluorescent lighting unit.

FIG. 3 illustrates one of the n lighting units referred to in FIG. 2 as LU1, LU2 -- LUn. This one lighting unit is referred to as LUx. It has a power input receptacle IR, which has two output terminals OTa and OTb, and comprises a pair of fluorescent lamps FL1 and FL2, a pair of corresponding ballasting inductors L1, L2 and ballasting cappacitors C1, C2. Fluorescent lamp FL1 has two thermionic cathodes TC1*a* and TC1*b*; and fluorescent lamp FL2 has two similar cazthodes TC2*a* and TC2*b*.

Inductor L1 is connected between output terminal QT*a* and one of the terminals of cathode TC1*a*. Capacitor C1 is connected between the other terminal of cathode TC1*a* and one of the terminals of cathode TC1*b*. The other terminal of cathode TC1*b* is connected with output terminal OT*b*.

Inductor L2 is connected between output terminal OT*a* and one of the terminals of cathode TC2*b*. Capacitor C2 is connected between the other terminal of cathode TC2*b* and one of the terminals of cathode TC2*a*. The other terminal of cathode TC2*a* is connected with output terminal OT*b*.

Figure 4:
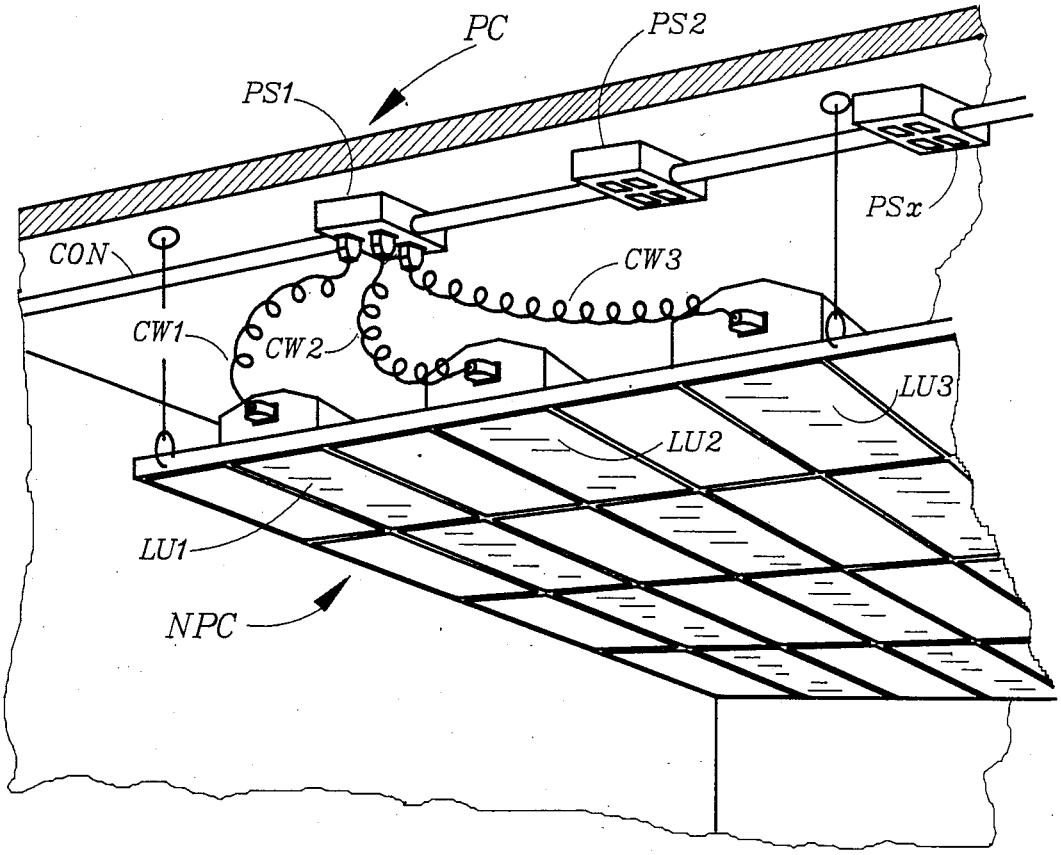
FIG. 4 schematically illustrates an installation of subject power-limited lighting system.

FIG. 4 illustrates an expectedly typical installation in a building of subject power-limited lighting system. The power line conductors are provided by way of conduit CON to a number of different power supplies: PS1, PS2, and PSx.

These power supplies are mounted (in a way similar to that of regular electrical junction boxes) onto the permanent ceiling PC. Suspended from this permanent ceiling is a non-permanent ceiling NPc; which non-permanent ceiling is an ordinary so-called suspended ceiling, which has a grid structure of suspended T-bars with ceiling panels and lighting fixtures used for filling in the openings in the grid structure. For sake of clarity, the suspended ceiling is shown without the ceiling panels. From each of the power supplies, a plurality of conduction wire-pairs provide for light-weight flexible plug-in connection with a like plurality of lighting units. However, for sake of clarity, only a few connections are specifically shown: From power supply PS1, connect wires CW1, CW2 and CW3 are shown to connect with lighting units LU1, LU2 and LU3.

Description of Operation

The operation and use of the subject power-limited lighting system may be explained as follows.

In FIG. 1, the pair of power line conductors PL1 and PL2 provides 120 Volt/60 Hz power to each and every inverter power supply: PS1, PS2–PSm.

Each of these inverter power supplies (Ex: PSx) converts its 120 Volt/60 Hz input voltage to a high-frequency output voltage; which output voltage is transformed by a transformer (T) to a magnitude of 100–150 Volt RMS and is supplied to each one of the plurality of output receptacles (Ex: OR1). The load current flowing to each of these output receptacles passes through a current sensor (Ex: CS1) and a circuit breaker (Ex: CB1); which, in combination, provide for distinct limitations on the magnitude of load current that can be supplied to any given output receptacle.

The current sensor (CS1), which is simply a small current transformer of conventional design, senses the load current flowing through it and provides a proportional sensor output current at its output. This sensor output current is fed into a load means (LM1), which then develops across it a sensor AC output voltage of magnitude substantially proportional to that of the load current flowing through the current sensor.

The sensor AC output voltage is rectified by a rectifier means (RMI), and the resulting sensor DC output current is applied to the charge-storing capacitor (CSC). Thus, this capacitor will eventually charge up to a DC voltage of magnitude proportional to that of the peak amplitude of the largest one of the various load currents flowing through the various current sensors (CS1, CS2–CSn) and to the different power output receptacles (OR1, OR2–ORn), with the time required to reach this magnitude being dependent on the magnitude of the capacitance of CSC, as well as on the net magnitude of the sum of all the resulting sensor DC output currents.

After the DC voltage across capacitor CSC reaches a certain threshold magnitude, the threshold device (TD) breaks down, and disable current from capacitor CSC is then provided, by way of the current-limiting resistor (CLR), to control terminal CTa of inverter I. (The threshold device could be a Diac, such as ST-2 from General Electric, which would have a break-down or threshold voltage of about 30 Volt.)

As soon as disable current is supplied to control terminal CTa, the inverter becomes disabled and the 30 kHz inverter output voltage disappears; which, of course, reduces the various load currents to zero.

The disablement of the inverter is accomplished by way of well known means, the details of which are herein omitted for the reason of overall clarity. In particular, the disablement is accomplished by way of an electrically actuatable switch means comprised within the inverter and connected in circuit with the B+ supply and the control terminals CTa, CTb. When, from the outside, the inverter is provided with a disable current by way of terminal CTa, this built-in switch means acts to prevent the flow of B+ current within the inverter, thereby stopping inverter operation. After having been disabled, the inverter will resume its operation again as soon as the magnitude of the disable current falls below a certain threshold level. (Of course, if required, it would readily be possible to provide for a latching effect, whereby the inverter would remain out of operation until line power is removed and then restored again.)

As with the current sensor (CS1), the circuit breaker (CB1) is also responsive to the current flowing through it. In particular, the circuit breaker is a normally-closed thermally-activated bimetallic switcher that operates to latch itself into an open circuit position in case the current flowing through it exceeds a certain pre-established RMS magnitude for more than a few seconds. After having latched itself into such an open-circuit position, power has to be removed to cause it to reset.

The purpose of the circuit breakers (Ex: CB1) within the various power supplies (Ex: PSx) is twofold: (i) to remove power from a given output receptaled (Ex: OR1) in case an excess current (i.e., more than 1.0 Amp) flows for longer than a brief period of time (i.e., for longer than about two to six seconds), and (ii) to comply with the "Maximum Over-current Protection" prescribed by the National Electrical Code for a "Not Inherently Limited Power Source" used in a Class-3 circuit.

The purpose of the current sensors (Ex: CS1) is also twofold: (i) to provide a relatively slow-acting back-up means for removing power from the output in case too much current (i.e., more than about 1.0 Amp) is flowing from at least one output receptacle for too long a time (i.e., for longer than about ten to thirty seconds), and (ii) to comply with the "Current Limitation" prescribed by the National Electrical Code for a "Not Inherently Limited Power Source" used in a Class-3 circuit.

Thus, in case of an overload condition caused by a given lighting unit (among the plurality of lighting units powered from a single power supply), the power supplied to that given lighting unit will be interrupted by way of the "Maximum Over-current Protection" means (i.e., by way of the particular circuit breaker associated with the given lighting unit)—leaving the remaining lighting units unaffected. However, if for some reason that particular circuit breaker were to malfunction (thereby leaving the overload condition in effect for a period of more than a few seconds), the power supply would be disabled by way of the "Current Limitation" means (i.e., by way of disabling the inverter I in the power supply PSx). Of course, in this case, the power to all the lighting units powered by that power supply would be interrupted.

After having been disabled, the inverter will remain disabled for a time-period TP, which will last until the disable current flowing from the charge-storing capacitor CSC has diminished below a certain threshold level. The length of time-period TP can routinely be designed to be as short or as long as desired. In the preferred embodiment herein, the time-period TP was shosen to be about five minutes.

However, it is also routinely possible to arrange for the inverter to become disabled in a latched fashion—using the power line voltage for the latching function. In this case, provided that the time-period TP is designed to be just a few seconds long, the inverter may be re-started at any time after having been disabled by simply removing the power line voltage for a brief period.

The fluorescent lamp ballasting arrangement shown in FIG. 3 is of a high-frequency resonant-type, and operates similarly to ballasting circuits previously described in published literature—such as, for instance, in U.S. Pat. No. 3,710,177 to Ward.

An important feature of these resonant or near-resonant ballasting circuits to the fact that they can be arranged to draw power from their source at a nearly unity (or 100%) power factor. In other words, for a given Volt-Ampere product available from a source (i.e., 100 Volt-Amp in case of the Class-3 circuits herein considered), the resonant ballast provides for the maximum possible power to be pulled from that source (i.e., 100 Watt from a Class-3 circuit).

FIG. 4 illustrates the use and installation in a building of the power-limited lighting system of FIG. 1, and shows two multi-output power supplies mounted on the permament ceiling above a non-permanent suspended ceiling.

Each of these multi-output power supplies has a plurality of output receptacles; and each of these receptacles provides an independently current-limited (or Volt-Amp-limited) AC voltage output.

A number of lighting units (of the type described in FIG. 3, but in the form of lighting fixtures and/or lighting panels) are fitted into the grid system of the suspended ceiling—much in the fashion of ordinary ceiling panels. Each of these lighting units are then connected by way of a plug-in flexible cord with one of the Volt-Amp-limited output receptacles of one of the multi-output power supplies mounted on the permanent ceiling above the grid structure.

It is emphasized that, as a result of the Class-3 current voltage, and Volt-Amp limitations provided on the outputs of the multi-output power supplies, the installation and use of the lighting units can be done with a freedom and flexibility far superior to that which otherwise would be permissible. In particular, the Class-3 classification permits the use of lighter and more flexible wires than are required in conventional installations, and implies that the cables connecting between the power supplies and the lighting units do not need to be conduited or armored.

Moreover, subject power-limited lighting system permits the use of convenient light-weight plug-in connect cords between the output receptacles on the multi-output power supplies and the input receptacles on the lighting units.

In an expectedly typical situation, subject power-limited lighting system would be installed as follows.

First: a number of multi-output power supplies would be permanently installed in suitable spaced-apart locations on the permanent ceiling; which permanent installation would probably be done by electricians.

Second: the grid structure for the suspended ceiling would be installed.

Third: lighting units or fixtures would be placed at suitable locations in the grid, probably by the same persons that installed the grid structure.

Fourth: each lighting unit would then be plug-in connected with a flexible cord to one of the Volt-Amp-limited output receptacles of the nearest multi-output power supply, which connections would also probably be done by the same persons that installed the grid structure.

Fifth: the regular ceiling panels would be installed.

Finally, the following points should be noted:

(a) It is not necessary that the multi-output power supplies comprise rectifier means, inverter means, and transformer means—as shown in FIG. 2. Rather, in order to comply with the Class-3 requirements in a basic sense, these power supplies need not contain anything more than the requisite current-limiting means; in which case a very simple power-limited lighting system could indeed be had.

(b) However, as long as the multi-output power supplies do provide output voltages of relatively high freqency (such as 30 kHz or so), the weight of the ballasting means in the fluorescent lighting fixtures (FIG. 3) becomes very small; which implies that the weight of the fluorescent lighting fixtures themselves becomes very small in comparison with the weight of ordinary fluorescent lighting fixtures. And, of course, the installation and/or removal of such lighter-weight lighting fixtures is easier than with the heavier fixtures.

(c) Class-2 operation may be used as a near equivalent to Class-3 operation; and—depending upon particular circumstances—still other forms of power-limited systems may be used: the most important aspect of the present invention being that of systematic power limiting to a degree considered by some authoritative entity (such as the NATIONAL FIRE PROTECTION ASSOCIATION) as being reasonably safe from a fire initiation viewpoint.

(d) As indicated in FIG. 2, the power or current limitation of subject Power-Limited Lighting System is accomplished in a manifest manner by means operative to sense output current and then, if this output current remains higher than a given pre-determined level for more than just a brief period, to provide for the output circuit to open or for the inverter to become disabled, thereby to reduce the output current to a level below this given pre-determined level. Thus, regardless of the nature of the load presented to this output, the output current can not exceed the given pre-determined level for more than a brief period of time.

In the referenced Related Patent Application, power limitation is accomplished by way of inductive impedance means; which implies that there is no manifest limit to the power that can be extracted from the output. For instance, by loading the output with a suitably chosen capacitive impedance means, essentially any level of power may be obtained.

(e) To comply with the spirit of the Class-3 "Current Limitation", it may be necessary to disable the inverter extra rapidly in case of very substantial over-current at any one of the several output receptacles (Ex. OR1 in FIG. 2). This can readily be accomplished by choice of the factors affecting the time-constant associated with charging capacitor CSC of FIG. 2.

(f) Details of the National Electrical Code are provided in a book entitled NATIONAL ELECTRICAL CODE 1984, published by NATIONAL FIRE PROTECTION ASSOCIATION, BATTERYMARCH PARK, QUINCY MA 02269. Article 725 of that CODE relates to Class-2 and Class-3 circuits.

(g) NATIONAL ELECTRICAL CODE 1984, and particularly Article 725 thereof, is herewith by reference made part of this specification.

It is believed that the present invention and its several attendant advantages and features will be understood from the preceeding description. However, without departing from the spirit of the invention, changes may be made in its form and in the construction and interrelationships of its component parts, the form herein presented merely representing the preferred embodiment.

I claim:

1. A lighting system adapted to be powered from an ordinary electric utility power line and comprising:

a central power conditioner adapted to connect with said power line and comprising a plurality of separate output means, each such output means having current limiting means and being operative to provide an electrical output that is individually and manifestly limited in terms of continuously available electric power to a level that is substantially lower than the electric power available directly from said power line, said level being low enough to be considered to be reasonably safe from a fire initiation viewpoint;

a plurality of lighting units, each lighting unit comprising an electric lamp and having electric input means operable to receive the electrical output from one of said output means; and a flexible cord and connect means for each lighting unit, said cord and connect means being operative to provide disconnectable connection between one of said output means and the input means of one of said lighting units, whereby each individual light units is connectable directly with the central power conditioner thereby permitting a lighting unit to be moved and re-located relative to, as well as to be removed and/or disconnected from, said power conditioner.

2. The lighting system of claim 1 wherein each of said electrical output means is manifestly limited to provide a maximum continuous power output on the order of 100 Watt or less.

3. The lighting system of claim 1 wherein one of said lighting units comprises a fluorescent lamp and ballasting means therefor.

4. The lighting system of claim 1 wherein the magnitude of the voltage of said eletrical output is substantially constant for as long as the current being drawn therefrom is not so high as to cause the resulting output power to exceed said level.

5. The lighting system of claim 1 wherein said power conditioner means comprises frequency conversion means, whereby the frequency of the voltages provided at said output means is different from that of the voltage provided by said power line.

6. The lighting system of claim 1 wherein at least one of said output means comprises receptacle means operable to receive and hold an electric plug means.

7. The lighting system of claim 1 wherein, if power in excess of about 100 Watt is drawn from a given output means for more than but a brief period, said given output means re-conditions itself such as to reduce this draw to a level not in excess of about 100 Watt.

8. The lighting system of claim 1 wherein: (i) said lighting units comprise receptacle means, and (ii) said connect cord means comprise plug means, said receptacle means being operable to receive and hold said plug means.

9. The lighting system of claim 1 wherein the power extractable from each one of said output means may substantially exceed said level for a brief period of time.

10. The lighting system of claim 1 wherein the electrical output characteristics of each one of said separate output means substantially conform to the specifications for Class-3 or Class-2 circuits as defined in Article 725 of NATIONAL ELECTRICAL CODE 1984.

11. The lighting system of claim 1 wherein the maximum power output directly available from the power line is of a magnitude that is regarded by an authoritative entity, such as the NATIONAL FIRE PROTECTION ASSOCIATION, as being potentially unsafe from a fire initiation viewpoint, while the maximum power output available by way of each one of said separate output means is limited to a magnitude that is regarded by said authoritative entity as being acceptably safe from a fire initiation viewpoint.

12. The lighting system of claim 1 adapted for use with a suspended ceiling, said suspended ceiling having a grid structure and being suspended some distance below a permanent ceiling, said lighting units being mounted in or on said grid structure.

13. The lighting system of claim 12 wherein said power conditioner is mounted in substantially rigid relationship with said permanent ceiling.

14. A lighting system for a suspended ceiling, said suspended ceiling having a grid structure and being suspended below a permanent ceiling, said system comprising:

a number of central power conditioners mounted some distance apart on said permanent ceiling, each of these power conditioners being connected with an ordinary electric utility power line and having a plurality of separate Volt-Amp-limited power outputs, with each such power output having current limiting means and being operative to supply an AC output current that is manifestly limited in magnitude to a degree such that the maximum energy flow extractable from each such power output stays below a level that is considered hazardous from a fire initiation viewpoint;

a set of lighting fixtures for each central power conditioner, each of said lighting fixtures being mounted in said grid structure and having: (i) an electric lamp, (ii) matching means operative to match the electrical input characteristics of said lamp with the electrical output characteristics of said power outputs, and (iii) electrical terminal means connected in circuit with said matching means and operable to receive power from one of said power outputs; and for each lighting fixture, a connect cord by which to connect that lighting fixture to one of said Volt-Amp-limited power outputs, whereby each individual light fixture is connected directly with one of the central power conditioner.

15. A lighting system adapted to be powered from an ordinary electric utility power line and comprising:

a number of power conditioners connected with said power line at different spaced-apart points therealong, each of said power conditioners having a plurality of separate power-limited outputs, each such output being limited in terms of maximum power extractable therefrom on a continuous basis to about 100 Watt or less, yet being capable for a brief period of time to supply power that is substantially in excess of 100 Watt;

a set of lighting fixtures for each power conditioner, each lighting fixture having: (i) an electric lamp, (ii) matching means operative to match the input characteristics of said lamp to the output characteristics of one of said outputs, and (iii) terminal means connected with said matching means and operative to receive the output from one of said outputs; and connect cords operative to provide connection between said lighting fixtures and said power-limited outputs, with each one of these connect cords being used for connecting between one of said outputs and said terminal means of one of said lighting fixtures, whereby each individual light fixture is connected directly with one of the power conditioner.

16. A lighting system comprising:

I. A central power conditioner adapted to be connected with and powered from an ordinary electric utility power line, said central power conditioner having:

(a) an input circuit connected with said power line and operative to provide an AC voltage at a pair of AC input terminals, said input circuit having a set of control terminals and being operative upon the receipt of a disable signal at said control terminals to substantially diminish the magnitude of said AC voltage; and (b) a plurality of pairs of AC output terminals, each one of these pairs of AC output terminals being individually and separately connected with said pair of AC input terminals by way of a current sensor and operative to provide an AC output, said current sensor being: (i) operative to sense the magnitude of current assocated with said AC output, (ii) connected in circuit with said control terminals, and (iii) operable to provide a disable signal to said control terminals in case the magnitude of the current associated with said AC output exceeds a pre-determined level for more than a certain length of time; and II. a plurality of lighting units, each lighting units being operative to connect with and to be powered from one of said pairs of AC output terminals;

whereby, if the magnitude of the current flowing from at least one of said pairs of AC output terminals exceeds said pre-determined level for more than a certain length of time, said AC voltage will substantially diminish in magnitude, thereby reducing the magnitude of the current associated with said AC output.

17. The lighting system of claim 16 wherein a current-responsive circuit breaker means is connected in circuit with at least one of said separate pairs of AC output terminals and operable to diminish the flow of current from said one pair in case the magnitude of the current flowing therefrom has exceeded a pre-determined over-current protection level for longer than a very brief period of time, whereby, if the current flowing from said one pair of AC output terminals exceeds said over-current protection level for longer than a very brief period of time, the magnitude of the current flowing from said one pair of output terminals will be diminished substantially without affecting the output provided from the other pairs of AC output terminals.

18. The power conditioner of claim 16 wherein said very brief period of time is shorter than certain length of time.

19. The power conditioner of claim 17 wherein said very brief period is on the order of ten seconds or less.

20. A lighting system comprising:

I. a central power conditioner adapted to be connected with and powered from an ordinary electric utility power line, said power conditioner having:

(a) a plurality of separate pairs of power output terminals;

(b) power distributing means operative to provide a current-limited output voltage at each individual one of said separate pairs of power output terminals;

(c) overcurrent protection means operative to effect a reduction in the magnitude of the voltage provided at any individual one pair of output terminals in case the current drawn therefrom has exceeded a pre-determined magnitude for longer than a brief period of time, said reduction being effected substantially without affecting the magnitude of the voltage provided at the other output terminals; and (d) current-limiting means operative to prevent the magnitude of the current drawn from any individual one pair of output terminals from reaching a magnitude that is considered by an authoritative entity, such as NATIONAL FIRE PROTECTION ASSOCIATION, as being unsafe from a fire initiation viewpoint; and II. a plurality of lighting units, each lighting unit being operative to connect with and to be powered from one of said plurality of separate pairs of output terminals;

whereby, even if the overcurrent protection means fails, the current-limiting means limits the magnitude of the current available from each individual one pair of output terminals to a magnitude that may be considered as being safe from a fire initiation viewpoint.

21. The lighting system of claim 20 wherein said central power conditioner comprises frequency converter means, whereby the frequency of the current-limited voltage provided at each of said plurality of pairs of output terminals is substantially higher than that of the voltage normally present on said power line.

* * * * *

Disclaimer 4,667,133.—*Ole K. Nilssen*, Barrington Hills, Ill. POWER-LIMITED LIGHTING SYSTEM. Patent dated May 19, 1987. Disclaimer filed Feb. 2, 1990, by the inventor.

The term of this patent subsequent to December, 2, 2003, has been disclaimed.

[ *Official Gazette April 24, 1990* ]